United States Patent [19]

Chrones

[11] 4,082,351

[45] Apr. 4, 1978

[54] SAFETY COVER FOR A DOOR KNOB

[75] Inventor: Anthony Chrones, Warwick, R.I.

[73] Assignee: Reliance Products Corporation, Woonsocket, R.I.

[21] Appl. No.: 773,644

[22] Filed: Mar. 2, 1977

[51] Int. Cl.[2] ..... E05C 21/00; E05B 13/00; E05B 1/04

[52] U.S. Cl. ..... 297/347; 16/121; 70/165; 74/558.5

[58] Field of Search ..... 16/121, 122, 123, 116 R; 74/558.5, 543, 553; 292/347, 1, DIG. 2; 70/165

[56] References Cited

U.S. PATENT DOCUMENTS

| | | | |
|---|---|---|---|
| 2,449,575 | 9/1948 | Wilhelm | 16/121 X |
| 2,587,285 | 2/1952 | Broscoe | 74/558.5 X |
| 2,610,877 | 9/1952 | Weaver | 292/DIG. 2 |
| 3,306,643 | 2/1967 | Reed | 292/DIG. 2 |

*Primary Examiner*—Louis K. Rimrodt
*Attorney, Agent, or Firm*—Cullen, Settle, Sloman & Cantor

[57] ABSTRACT

A safety cover for a door knob is designed to complicate the opening of the door by small children but permits the opening of the door by other persons by proper manipulation of the safety cover. A pair of inner and outer annular cover parts with interengaging fastening formations surround the shank and door knob. A resilient pressure pad is carried by the outer cover part between a flexible wall portion thereof and the front surface of the door knob. The safety cover when turned by a small child rotates freely on the door knob. When a sufficient force is applied to the flexible wall portion of the outer cover part, the resilient pressure pad is urged against the front surface of the door knob to frictionally grip same thus permitting the safety cover to turn the door knob.

13 Claims, 7 Drawing Figures

SAFETY COVER FOR A DOOR KNOB

BACKGROUND OF THE PRESENT INVENTION

1. Field of the Invention

The safety cover is for use with any door having a rotatable latch as is conventionally used in houses, schools, stores, etc. A child or infant at a very early age attempts to open doors by rotating the knob. If proper supervision is not provided there is always a possiblity that the child will encounter certain dangerous situations such as stairs or objects which could fall on and injure the infant if access is permitted to an unattended room or area, etc.

2. Description of the Prior Art

Access to unattended areas through doors can be prevented by locks, keys, etc. However, the locking of inner doors in a home is not recommended for safety reasons and is also not convenient to adults and children above the age of 4 years.

SUMMARY OF THE PRESENT INVENTION

It is a feature of the present invention to provide a safety cover for a door knob which is designed to complicate the opening of the door by small children but permits the opening of the door by other persons by proper manipulation of the safety cover.

A further feature of the present invention is to provide a safety cover of the aforementioned type which turns freely on the door knob when turned by a small child but effectively grips the door knob for opening same when properly manipulated by a person of sufficient age and know-how.

A still further feature of the present invention is to provide a safety cover of the aforementioned type which includes a pair of inner and outer cover parts designed to fit around the door knob and shank and which are provided with interengaging annular fastening formations which permit the cover parts to be snapped together.

Another feature of the present invention is to provide a safety cover of the aforementioned type, with the outer cover part being provided with a flexible wall portion and including a resilient pressure pad abutting the flexible wall portion and adapted for frictional engagement with the door knob for turning same.

Still another feature of the present invention is to provide a safety cover of the aforementioned type wherein the cover parts are made from a plastic material and the resilient pressure pad is made from a rubber-like or yieldable material.

A further feature is to provide a safety cover which is safe, simple in construction, economical to manufacture, easy to assemble and install, and which can be operated by adults to turn the door knob but not by infants and small children.

DESCRIPTION OF A PREFERRED EMBODIMENT

Figures 1, 2, 3, 4, 5, 6, 7:
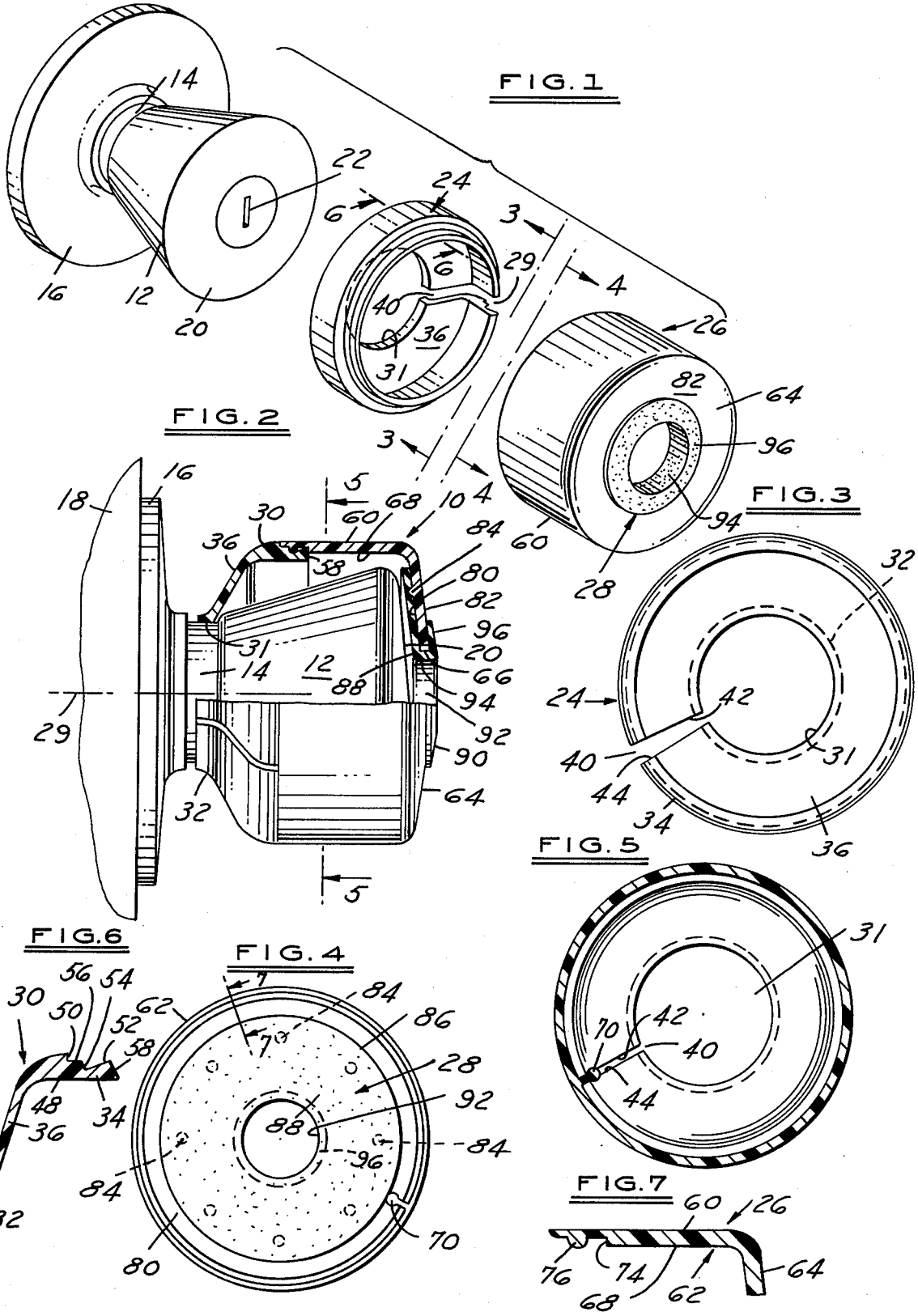
FIG. 1 is a perspective view of the safety cover, with the inner and outer cover parts separated, ready for mounting on a door knob.
FIG. 2 is a side elevational view, partly in section, of the safety cover and door knob assembly.
FIG. 3 is a front view of the inner cover part taken on the line 3—3 of FIG. 1.
FIG. 4 is a back view of the outer cover part showing the interior thereof and taken on the line 4—4 of FIG. 1.
FIG. 5 is a sectional view taken on the line 5—5 of FIG. 2.
FIG. 6 is an enlarged fragmentary sectional view through the inner cover part taken on the line 6—6 of FIG. 1.
FIG. 7 is an enlarged fragmentary sectional view through the outer cover part taken on the line 7—7 of FIG. 4.

The safety cover is designated by the numeral 10 and is adapted to be mounted over a conventional door knob 12 and shank 14 (FIG. 2) which are mounted by a plate 16 to the door 18 as is well known in the art. The door knob 12 has a front surface 20 and carries a lock, not shown, which is operated in the usual manner by a key inserted in the opening 22. This invention may be used with any rotatable door knob regardless of whether it may be locked or not.

The safety cover 10 has three components including an inner cover part 24, an outer cover part 26 and an annular relatively thin flexible pressure pad or disc 28 carried by the outer cover part 26 as will be subsequently described. The inner and outer cover parts 24 and 26 have an axis 29 (FIG. 2) which is generally coincidental with the door knob axis.

The inner cover part 24 has an annular ring-like or cup portion 30 which is provided at one side thereof with a centrally located opening 31. A shank engaging rim portion 32 surrounds opening 31 and forms a portion of the inner cover part 24. The other side of the ring-like por- 30 terminates in an annular fastening formation 34. The annular rim portion 32 and annular fastening formation 34, which is formed on a diameter larger than the diameter of the rim portion 32, are connected by a tapered wall section or area 36.

A slot or opening 40 extending radially outwardly from axis 29 separates the inner cover part 24 and permits the cover part 24 to be circumferentially expanded to fit over the shank 14 and into the outer cover part 26. The inner cover part 24 has oppositely facing surfaces 42, 44 on opposite sides of slot 40. The slot 40 extends through the rim portion 32, tapered wall section 36 and annular fastening formation 34.

The annular fastening formation 34 has a smooth inner surface 48 in the form of a cylinder; an outer surface provided with a first annular abutment 50 for limiting the insertion of the inner cover part 24 into the outer cover part 26; and an annular tapered ramp or groove 52 terminating in a second annular abutment 54 which is spaced from the first abutment 50 and is connected thereto by an annular shoulder 56. The annular face or surface on inner cover part 24 is designated by the numeral 58.

The outer cover part 26 includes a cylindrical portion or rim 60 having at one edge thereof an annular fastening formation 62 and at the other edge thereof a depending flexible generally tapered wall portion 64 provided therein with a centrally located opening 66.

The cylindrical portion 60 is in the form of a cylinder, has a smooth inner surface 68 and is provided with an upstanding locating rib or bar 70 which extends from the tapered wall 64 to said one edge thereof at the open end of the outer cover part 26. The fastening formation 62 includes an inner annular stop abutment 74 engageable with the annular face or surface 58 of inner cover part 24 and an annular raised shoulder or rib 76 which snaps into and is held against the tapered ramp or groove 52 of the inner cover part 24 to thereby hold the cover parts 24 and 26 in a predetermined assembled relationship. During the assembly of the inner and outer cover parts 24, 26 the inner apart 24 is inserted into the outer cover part 26 with the slot 40 spanning the elongated ridge 70 as shown in FIG. 5.

The flexible tapered wall portion 64 has an inner surface 80 and an outer surface 82. The inner surface 80 is provided with an annular series of raised projections or bumps 84 (FIG. 4). The bumps are very small and each has a height of approximate 1/16 inch or less.

The flexible pressure pad 28 includes an annular disc portion 86 having inner and outer surfaces 88 and 90. The outer surface 90 engages the inner surface 80 and the raised projections 84 of the flexible tapered wall portion 64 as shown in FIGS. 2 and 4. The projections 84 assist in preventing the pad 28 from turning independently of the cover parts. The pad 28 has a centrally located opening 92 therein which extends through the disc portion 86. At the back or outer surface 90, the disc portion 86 is provided with an annular rim 94 terminating in an annular flange 96 as shown in FIGS. 1 and 2. The annular rim 94 extends through the opening 66 provided in the flexible wall portion 64, with the flange 96 engaging the outer surface 82 as best shown in FIG. 2. The pad 28 is thus carried by the flexible wall portion 64 of the outer cover part 26.

The inner and outer cover parts 24, 26 are made from a non-toxic plastic material by a conventional molding operation. The flexible pad 28 is made from a flexible material such as neoprene, rubber or any suitable flexible or rubber-like material by a conventional molding operation.

The safety covers 10 may be made in various sizes to fit different size door knobs.

In use, the inner cover part 24 is separated from the outer cover part 26 which carries the pressure pad 28. The inner cover part 24 is expanded by moving the surfaces 42, 44 apart and thereafter it is inserted over the door shank 14 and knob 12. When so mounted the annular rim portion 32 engages the door shank 14 and the ring-like portion 30 surrounds part of the door knob 12. Finally, the outer cover part 26 is inserted over the remaining portion of the door knob 12 and the locating ridge 70 thereof is aligned with the slot 40 in the inner cover part 24. Thereafter the annular fastening formations 34, 62 on both cover parts 24, 26 are removably snapped together in the manner disclosed previously.

When the safety cover 10 is mounted as just described, rotation of the assembled parts 24, 26 is effective to spin the parts on the knob 12 and shank 14. A person must have sufficient strength and know-how to turn the knob 12 via the safety cover 10. This is achieved by a person applying a sufficient force to the front surface 82 of the flexible wall portion 64 to depress or flex same inwardly towards the knob 12 thus urging the annular flexible disc 86 against and into frictional contact with the front surface 20 of knob 12. When completed, the person maintains the friction contact between the pad 28 and knob 12 and rotates the safety cover 10 which turns the knob 12, thus opening the door 18.

What is claimed is:

1. A safety cover for application to a door knob which is assembled on a door and designed to complicate the opening of the door by small children comprising a pair of inner and outer annular cover parts having a hollow interior, with the inner cover part having a shank engaging rim portion surrounding a centrally located opening therein and an annular ring-like portion terminating in an annular fastening formation, a slot extending through said rim portion and annular ring-like portion to permit the opening of said inner cover part for placement of the rim portion thereof around the shank of the door knob and said ring-like portion around and spaced from a portion of the door knob, said outer cover part including a cylindrical portion surrounding and spaced from the remaining portion of the door knob and having at one edge thereof an annular fastening formation for engaging and completely covering the fastening formation on said inner cover part, said engaged formations being hidden from view, the other edge of said cylindrical portion having a depending flexible wall portion which faces the front surface of the door knob and is provided with a centrally located opening therein, said flexible wall portion having inner and outer surfaces, a resiliently relatively thin pressure pad carried by said outer cover part and abutting the inner surface of said flexible plate portion for frictional engagement with the front surface of the door knob, said safety cover when turned rotating freely on the door knob and shank, said safety cover gripping the door knob and turning same when a sufficient force is applied to the outer surface of said flexible wall portion which urges said pressure pad against and into frictional engagement with the front surface of the door knob.

2. The safety cover of claim 1 wherein said flexible wall portion is tapered to permit the flexing thereof.

3. The safety cover of claim 1 wherein said resilient pressure pad is provided with an annular rim terminating in an annular flange, with the annular rim extending through the centrally located opening in said flexible wall portion and with said annular flange engaging the outer surface of said flexible wall portion to secure said pad to said flexible wall portion.

4. The safety cover of claim 1 wherein the annular fastening formation of said inner cover part is in the form of an annular groove and the annular fastening formation of said outer cover part is in the form of an annular rib which snaps into the annular groove when the inner and outer cover parts are assembled.

5. The safety cover of claim 1 wherein the cylindrical portion of said outer cover part is provided with a locating ridge extending from said one edge to the other edge thereof, said ridge extending through the slot of said inner cover part for locating the parts in proper relationship.

6. The safety cover of claim 1 wherein the inner surface of said flexible wall portion is provided with an annular series of raised projections which engage the pressure pad and assist in preventing relative motion between the pad and the cover parts.

7. A safety cover for application to a door knob which is assembled on a door and designed to complicate the opening of a door by small children comprising a pair of inner and outer annular cover parts having a hollow interior, with the inner cover part having a shank engaging rim portion surrounding a centrally located opening therein and an annular ring-like portion terminating in an annular fastening formation, a slot extending through said rim portion and annular ring-like portion, said outer cover part including a cylindrical portion having at one edge thereof an annular fastening formation engaging and completely covering the fastening formation on said inner cover part, said engaged formations being hidden from view, the other edge of said cylindrical portion having a flexible wall portion extending transversely thereof and provided with a centrally located opening therein, said flexible wall portion having inner and outer surfaces, and a resilient relatively thin pressure pad carried by said outer cover part and abutting the inner surface of said flexible plate portion and adapted for frictional engagement with the front surface of a door knob.

8. The safety cover of claim 7 wherein said flexible wall portion is tapered to permit the flexing thereof.

9. The safety cover of claim 7 wherein said resilient pressure pad is provided with an annular rim terminating in an annular flange, with the annular rim extending through the centrally located opening in said flexible wall portion and with said annular flange engaging the outer surface of said flexible wall portion to secure said pad to said flexible wall portion.

10. The safety cover of claim 7 wherein the annular fastening formation of said inner cover part is in the form of an annular groove and the annular fastening formation of said outer cover part is in the form of an annular rib which snaps into the annular groove when the inner and outer cover parts are assembled.

11. The safety cover of claim 7 wherein the cylindrical portion of said outer cover part is provided with a locating ridge extending from said one edge to the other edge which extends through the slot of said inner cover part for locating the parts in proper relationship.

12. The safety cover of claim 7 wherein the inner surface of said flexible wall portion is provided with an annular series of raised projections which engage the pressure pad and assist in preventing relative motion between the pad and the inner and outer cover parts.

13. The safety cover of claim 7 wherein said slot extends radially outwardly from the axis of the centrally located opening in said inner cover part.

* * * * *